US006384877B1

(12) United States Patent
Socias Batet et al.

(10) Patent No.: US 6,384,877 B1
(45) Date of Patent: May 7, 2002

(54) MONITOR FOR SPORTS STADIUMS

(75) Inventors: Marcelino Socias Batet; Sergio Campoy Odena, both of Madrid (ES)

(73) Assignees: International Sports Organization, S.A.; Odeo Electronica, S.A., both of Madrid (ES)

( * ) Notice: Subject to any disclaimer, the term of this patent is extended or adjusted under 35 U.S.C. 154(b) by 0 days.

(21) Appl. No.: 09/496,523

(22) Filed: Feb. 2, 2000

(30) Foreign Application Priority Data

Aug. 2, 1999 (ES) ..... 9902058

(51) Int. Cl.[7] ..... H04H 5/64
(52) U.S. Cl. ..... 348/842; 40/452; 40/608
(58) Field of Search ..... 248/566, 631; 108/9, 7, 2; 40/452, 608, 610; 348/842, 838

(56) References Cited

U.S. PATENT DOCUMENTS 3,745,935 A * 7/1973 Douglas ..... 108/9
4,575,036 A * 3/1986 Allekotte ..... 40/608
5,043,716 A * 8/1991 Latyz et al. ..... 40/452

FOREIGN PATENT DOCUMENTS

CH 10060 * 2/1895 ..... 108/9

* cited by examiner

*Primary Examiner*—Peter M. Cuomo
*Assistant Examiner*—Jerry Anderson
(74) *Attorney, Agent, or Firm*—Collard & Roe, P.C.

(57) ABSTRACT

An improved monitor for sports stadiums consisting of a module, which adopts a flat parallelepiped shape, and is fitted on its front side with a display screen, The module is supported by a structure comprising a frame, a base and two shock absorbers mounted between the base and frame to permit backward movement of the frame upon impact. The display screen is based on light emitting diode (LED) technology suitable for displaying moving images and advertisements, covered by a polycarbonate sheet, and contains a hemispherical protrusion that is fitted around each of the light points formed by the light emitting diodes. The shock absorbers are adjustable via holes in the base and frame and there is a handle and latch to permit easy transport of the monitor.

6 Claims, 2 Drawing Sheets

MONITOR FOR SPORTS STADIUMS

BACKGROUND OF THE INVENTION

1. Field of the Invention

The present invention relates to an improved monitor for sports stadiums which allows advertisements and moving images to be displayed, or to be used for any other suitable purpose, 2. The Prior Art The invention is based on LED technology and can be installed in sports stadiums in order to display advertisements in a dynamic fashion or show images in motion, resulting in increased space efficiency and greater attention from the spectators.

Presently, it is common to display advertisements in sports stadiums, because of the considerable impact involved. These advertisements are mainly displayed on static panels placed at ground level around the sports field.

Many sporting events are broadcast on a national and international level and this enhances the potential effect of the advertisement, since it is viewed both by the spectators in the stadium and the audience watching their TV screens.

SUMMARY OF THE INVENTION

The monitor according to the invention is equipped for installation at ground level of the stadium. Therefore, the images displayed on the monitors are directly within the spectator's field of vision. The invention also facilitates viewing advertisements on the TV screen without interfering with the action of the game.

This invention consists of a display screen using LED (light emitting diode) technology and is formed by a plurality of luminous points capable of displaying moving images.

The screen offers a wide angle of vision, of about 120°. Therefore, it may be seen from a distance. The screen can also withstand any type of light exposure, i.e. solar, or floodlights, etc., without reflections that would otherwise reduce its effect or possibly disturb the players. This is accomplished by supplying the monitor with an automatic luminosity adjustment system that adapts the intensity of the luminous modules without disturbing the players.

Furthermore, the screen is designed with a polycarbonate front panel of a hemispherical shape in order to avoid reflections from external sources. This polycarbonate front is sufficiently rigid and strong so as to withstand a direct impact from a ball traveling at a speed above 100 km/h, In order to absorb the impact from a player, the screen is slantingly attached to a stable base and is fitted with a system of shock absorbers to present a low resistance in case of impact. The screen is capable of tilting backwards and then easily recovering its position after absorbing the force of the collision from the player, thus reducing the effect of the impact.

The display screen is encased in a frame made of a lightweight, highly weather-resistant material, preferably aluminum, and is fitted with transport side handles. In order to facilitate transport, the base may be folded onto the back of the screen by overcoming the resistance of the shock absorbers. This closed position is maintained by a pair of latches installed at the back of the base, so that the module maintains a flat form that is suitable for transport.

In order to adjust the incline of the screen with respect to the ground, each absorber leans on supports positioned over a perforated strip that allows the leaning position to be varied for maximum visibility. In addition, the pressure exerted by the absorbers can be adjusted to respond appropriately in the event of impact from a player.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
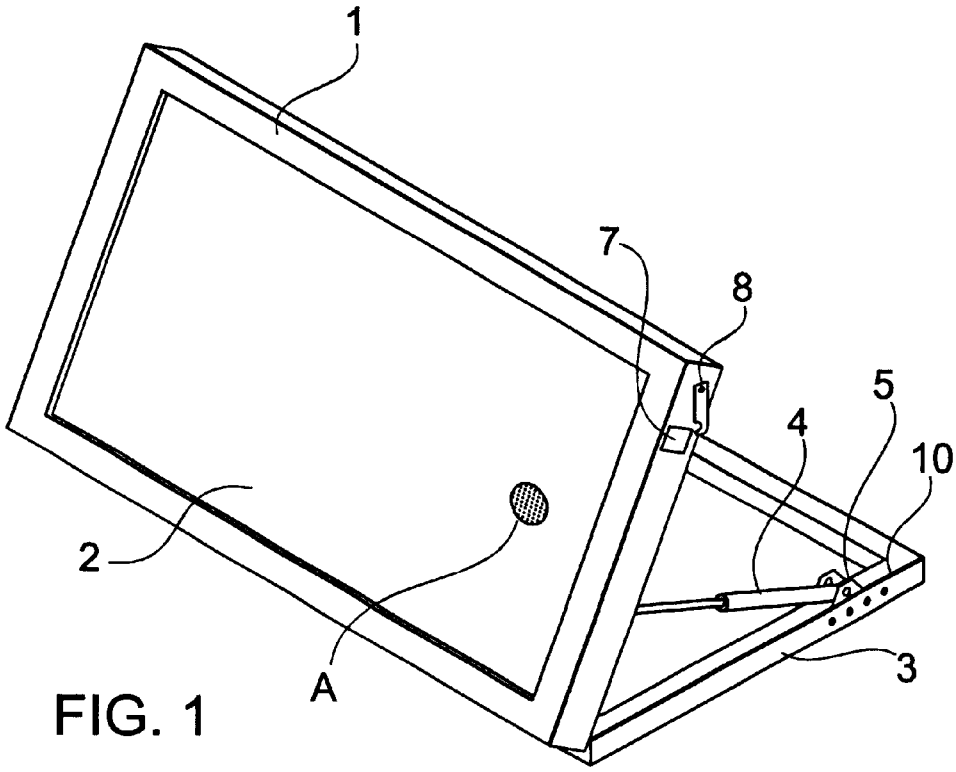
FIG. 1 shows a perspective view in partial cross-section of the monitor according to the invention.
Figure 2:
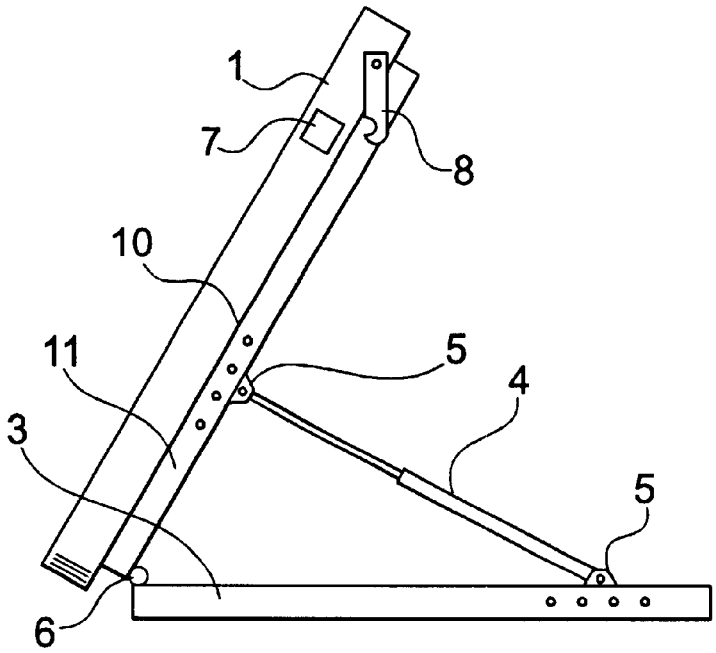
FIG 2 shows a side view of the monitor shown in FIG. 1.
Figure 3:
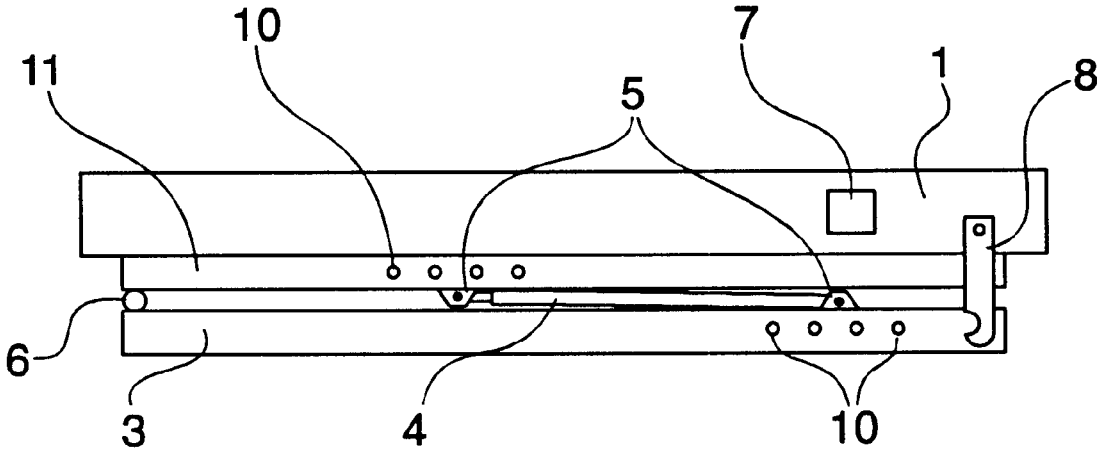
FIG. 3 shows a side view of the monitor as folded for transport.
Figure 4:
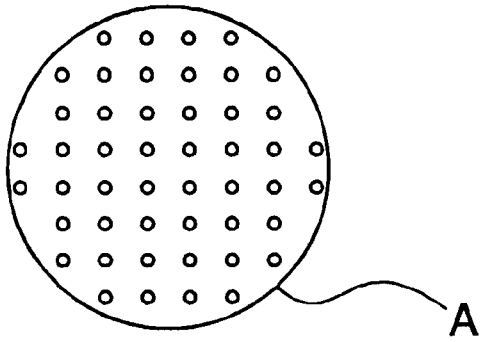
FIG. 4 shows a detail of the display screen.

Referring now in detail to the drawings and, in particular, FIGS. 1–3, there is shown an improved monitor for sports stadiums, which consists of module 1 that adopts a substantially flat parallelepiped shape and is fitted with a display screen 2 on its front (main) side and a frame 11 on its rear side with which it preferably adopts a rectangular plan arrangement. Display screen 2 is positioned on the front side of module 1 and is built of a high-strength external material, preferably polycarbonate. Screen 2 comprises a plurality of hemispherical protrusions 9 uniformly distributed over a mosaic of luminous points or light emitting diodes (LEDs).

Frame 11 is attached to a preferably rectangular base 3 by a hinge 6, along its lower portion. Between base 3 and frame 11, two shock absorbers 4 are installed, one on each side, .attached by their respective ends to supports 5 respectively located over frame 11 and base 3 beams. Each support 5 has a means of attachment with screws, via a row of holes 10 being provided in frames 3 and 11 for adjustment purposes.

On the distal ends of the base 3 and frame 11, opposite hinge 6, a latch 8 is provided for folding the structure, and module 1 is fitted with an embedded handle 7 on each side for ease of transport.

Accordingly, while only one embodiment of the present invention has been shown and described, it is obvious that many changes and modifications may be made thereunto without departing from the spirit and scope of the invention.

What is claimed is:

1. A monitor for sports stadiums, comprising: a module having a flat parallelepiped shape and comprising:

(a) a display screen on a front side of the module, said display screen containing light emitting diodes (LEDs) for displaying moving images;

(b) a sheet covering the display screen; and (c) a hemispherical protrusion fitted around each light point created by each LED;

a frame connected to the module;

a base connected to the frame via hinges along a lower edge of said frame and said base supporting the frame and module; and two shock absorbers mounted between the base and frame for permitting a backward pivoting movement of the frame.

2. The monitor according to claim 1, wherein said frame and base each adopt a rectangular plan configuration.

3. The monitor according to claim 1, wherein each shock absorber is attached to said frame and said base through supports, said supports being movable along a row of holes in frame and said base.

4. The monitor according to claim 1, wherein said monitor contains a luminosity control for said display screen.

5. The monitor according to claim 1, further comprising a handle and a latch on at least one of the frame and base.

6. The monitor according to claim 1, wherein the sheet is polycarbonate.

* * * * *